US008392184B2

(12) United States Patent
Buck et al.

(10) Patent No.: US 8,392,184 B2
(45) Date of Patent: Mar. 5, 2013

(54) FILTERING OF BEAMFORMED SPEECH SIGNALS

(75) Inventors: Markus Buck, Biberach (DE); Klaus Scheufele, Aalen (DE)

(73) Assignee: Nuance Communications, Inc., Burlington, MA (US)

( * ) Notice: Subject to any disclaimer, the term of this patent is extended or adjusted under 35 U.S.C. 154(b) by 1028 days.

(21) Appl. No.: 12/357,258

(22) Filed: Jan. 21, 2009

(65) Prior Publication Data

US 2009/0192796 A1 Jul. 30, 2009

(30) Foreign Application Priority Data

Jan. 17, 2008 (EP) ..... 08000870

(51) Int. Cl.
*G10L 15/20* (2006.01)

(52) U.S. Cl. ..... 704/233; 704/232; 704/259

(58) Field of Classification Search ..... None
See application file for complete search history.

(56) References Cited

U.S. PATENT DOCUMENTS

| | | | | |
|---|---|---|---|---|
| 2003/0177007 | A1* | 9/2003 | Kanazawa et al. | 704/233 |
| 2004/0170284 | A1* | 9/2004 | Janse et al. | 381/66 |
| 2007/0033020 | A1* | 2/2007 | (Kelleher) Francois et al. | 704/226 |
| 2007/0088544 | A1* | 4/2007 | Acero et al. | 704/226 |
| 2007/0100605 | A1* | 5/2007 | Renevey et al. | 704/201 |
| 2008/0201138 | A1* | 8/2008 | Visser et al. | 704/227 |
| 2009/0089053 | A1* | 4/2009 | Wang et al. | 704/233 |

OTHER PUBLICATIONS

Seltzer, et al.; Microphone Array Post-Filter Using Incremental Bayes Learning to Track the Spatial Distributions of Speech and Noise; Microsoft Research, Redmond, WA; 4 pp, 2007.
Lefkimmiatis, et al.; A Generalized Estimation Approach for Linear and Nonlinear Microphone Array Post-Filters; School of Electrical and Computer Engineering; National Technical University of Athens, Athens, Greece; Feb. 4, 2007; pp. 658-666.
McCowan, et al.; Microphone Array Post-Filter for Diffuse Noise Field; Dalle Molle Institute for Perceptual Artificial Intelligence (IDIAP), Martigny, Switzerland, 2002 IEEE; pp. I-905-I-908.
Liu, et al.; A Compact Multi-Sensor Headset for Hands-Free Communication; Microsoft Research, Redmond, WA; 2005 IEEE Workshop on Applications of Signal Processing and Audio and Acoustics, Oct. 16-19, 2005; pp. 138-141.
Cohen, et al.; Microphone Array Post-Filtering for Non-Stationary Noise Suppression; Yokneam Ilit, Israel; 2002 IEEE; pp. I-901-I-904.
Dam, et al.; Post-Filtering Techniques for Directive Non-Stationary Source Combined with Stationary Noise Utilizing Spatial Spectral Processing; Western Australian Telecommunications Research Institute (WATRI); Perth, Western Australia; 2006 IEEE; APCCAS 2006; pp. 824-827.
Fischer, et al.; Broadband Beamforming with Adaptive Postfiltering for Speech Acquisition in Noisy Enviroments; 1997 IEEE; pp. 359-362.

* cited by examiner

*Primary Examiner* — Leonard Saint Cyr
(74) *Attorney, Agent, or Firm* — Sunstein Kann Murphy & Timbers LLP

(57) ABSTRACT

The invention relates to speech signal processing that detects a speech signal from more than one microphone and obtains microphone signals that are processed by a beamformer to obtain a beamformed signal that is post-filtered signal with a filter that employs adaptable filter weights to obtain an enhanced beamformed signal with the post-filter adapting the filter weights with previously learned filter weights.

21 Claims, 3 Drawing Sheets

FILTERING OF BEAMFORMED SPEECH SIGNALS

RELATED APPLICATION

This application claims priority of European Patent Application Serial Number 08 000 870.9, filed on Jan. 17, 2008, titled POST-FILTER FOR BEAMFORMING MEANS, which application is incorporated in its entirety by reference in this application.

BACKGROUND OF THE INVENTION

1. Field of the Invention

This invention relates to processing of beamformed signals, and in particular to post-filtering of beamformed signals.

2. Related Art

Background noise is often a problem in audio communication between two or more parties, such as radio or cellular communication. Background noise in noisy environments directly affects the quality and intelligibility of voice conversations, and in the worst cases, the background noise may even lead to a complete breakdown of communication. With the use of hands-free voice communion devices in vehicles increasing, the quality and intelligibility of a voice communication signal is becoming more of an issue.

Hands-free telephones provide a comfortable and safe communication system of particular use in motor vehicles. The use of hands-free telephones in vehicles have also been promoted by laws enacted in many cities, such as Chicago, Ill., that requires the operator of a vehicle to use a hand-free device when making or receiving cellular telephones calls while operating the vehicle.

In addition to the quality of the voice communication signal between the parties on a telephone call, vehicles and communication devices are making use of voice commands. Voice commands often rely on voice recognition of words. If the voice command is issued in an environment with background noise, it may be misinterpreted or be unintelligible to the receiving device. Once again, the use of single channel noise reduction is desirable in such devices.

Approaches to single channel noise reduction methods employing spectral subtraction are known in the art. Such as, speech signals being divided into sub-bands by sub-band filtering where a noise reduction algorithm is applied to each of the sub-bands. These types of approaches, however, are limited to almost stationary noise perturbations and positive signal-to-noise distances. The processed speech signals are also distorted by these approaches, since the noise perturbations are not eliminated but rather spectral components that are affected by noise are damped. The intelligibility of speech signals is, thus, normally not improved sufficiently by these approaches.

Current multi-channel systems primarily make use of adaptive or non-adaptive beamformers, see, e.g., "Optimum Array Processing, Part IV of Detection, Estimation, and Modulation Theory" by H. L. van Trees, Wiley & Sons, New York 2002. The beamformer may combine multiple microphone input signals to one beamformed signal with an enhanced signal-to-noise ratio (SNR). Beamforming typically requires amplification of microphone signals corresponding to audio signals detected from a wanted signal direction by equal phase addition and attenuation of microphone signals corresponding to audio signals generated at positions in other direction.

The beamforming may be performed, in some approaches, by a fixed beamformer or an adaptive beamformer characterized by a permanent adaptation of processing parameters such as filter coefficients during operation (see e.g., "Adaptive beamforming for audio signal acquisition", by Herbordt, W. and Kellermann, W., in "Adaptive signal processing: applications to real-world problems", p. 155, Springer, Berlin 2003). By beamforming, the signal can be spatially filtered depending on the direction of the inclination of the sound detected by multiple microphones.

However, suppression of background noise in the context of beamforming is highly frequency-dependent and thus rather limited. Therefore, approaches that employ post-filters for processing the beamformed signals may be necessary in order to further reduce noise. But, such post-filters result in a time-dependent spectral weighting that is to be re-calculated in each signal frame. The determination of optimal weights, i.e., the filter characteristics, of the post-filters is still a major problem in the art. For instance, the weights are determined by means of coherence models or models based on the spatial energy. However, such relatively inflexible models do not allow for sufficiently suitable weights in the case of highly time-dependent strong noise perturbations.

Thus, there is a need for providing an approach for filtering background noise in the context of beamforming that overcomes the limitations of traditional post-filtering of the beamformed signal to reduce background noise.

SUMMARY

According to one implementation, an approach for reducing background noise via post-filtering of beamformed signals is described. A speech signal from more than one microphone is obtained as microphone signals. The microphone signals may then be processed by a beamformer to obtain a beamformed signal. A feature extractor may then extract at least one feature from the beamformed signal. A non-linear mapping module may then apply the extracted feature to generate learned filter weights in view of previous learned filter weights. The learned filter weights may then be employed by a post-filter for post-filtering the beamformed signals to obtain an enhanced beamformed signal that has reduced background noise.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
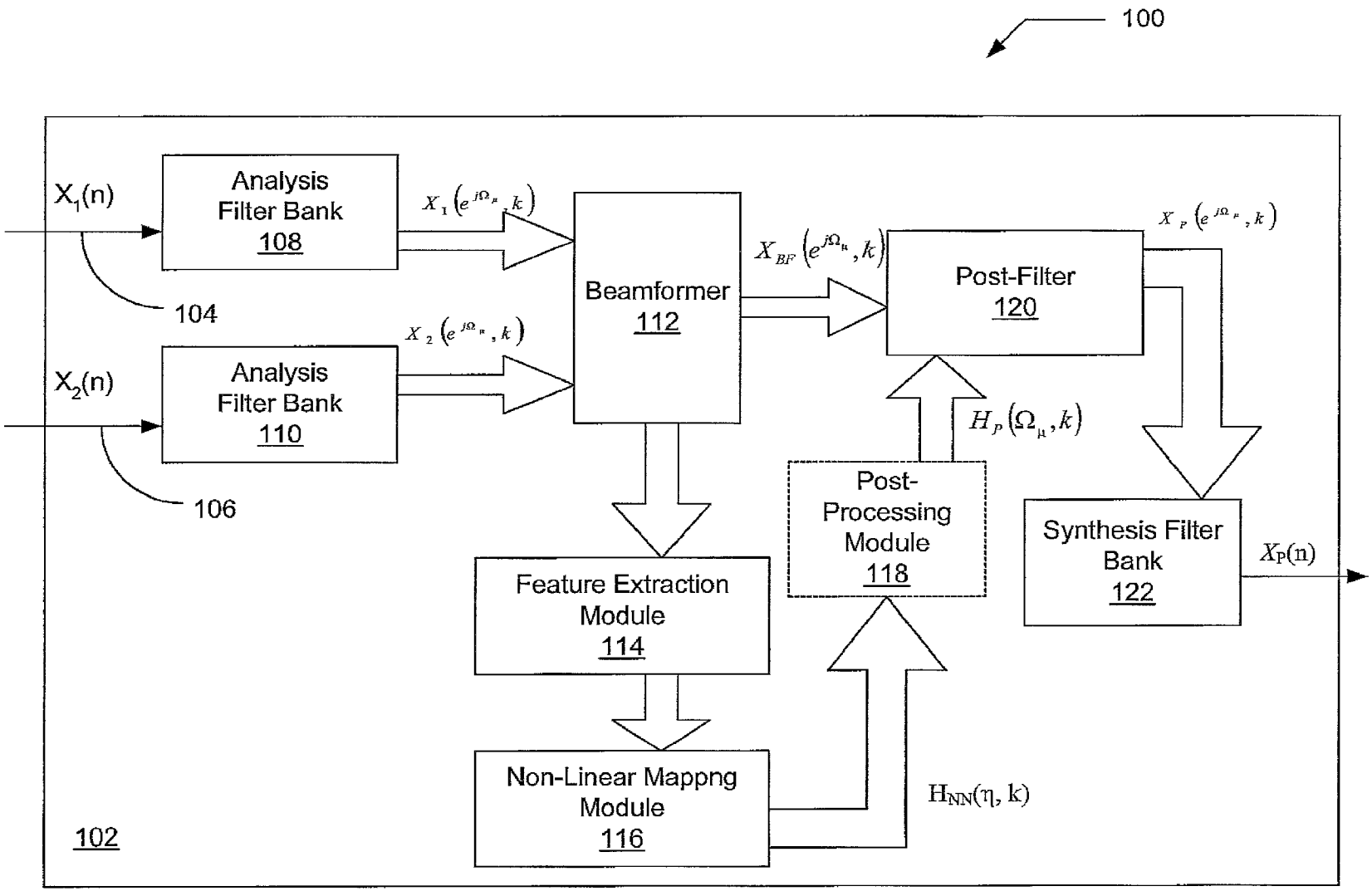
FIG. 1 is a block diagram of an example of signal processing in a signal processor of a beamformed signal according to an implementation of the invention.

In the following detailed description of the examples of various implementations, it will be understood that any direct connection or coupling between functional blocks, devices, components or other physical or functional units shown in the drawings or description in this application could also be implemented by an indirect connection or coupling. It will also be understood that the features of the various implementations described in this application may be combined with each other, unless specifically noted otherwise.

In the following, speech signal processing of a beamformed signal from a beamformer in the sub-band domain is described, for example. In this regime, the present invention provides a method for an optimal choice of filter weights $H_P$ used for spectral weighting of spectral components of a beamformer $X_{BF}$ output signal:

$$X_P(e^{j\Omega_\mu},k)=X_{BF}(e^{j\Omega_\mu},k)\cdot H_P(\Omega_\mu,k)$$

in conventional notation where sub-bands are denoted by $\Omega_\mu$, $\mu=1, \ldots m$ and where k is the discrete time index. According to the present invention the filter weights $H_P$ are obtained by means of previously learned filter weights.

In FIG. 1, a block diagram 100 of an example of signal processing in a signal processor 100 with a beamformed signal according to an implementation of the invention. A microphone array of two microphones in the current implementation generate microphone signals $x_1(n)$ 104 and $x_2(n)$ 106 where n is the time index on the microphone signals. Note that the sub-band signals are, in general, sub-sampled with respect to the microphone signal 104 and 106. Generalization to an implementation with a microphone array comprising more than two microphones may be implemented in other implementations.

The microphone signals $x_1(n)$ 104 and $x_2(n)$ 106 may be divided by analysis filter banks 108 and 110 into microphone sub-band signals $X_1(e^{j\Omega_\mu}, k)$ and $X_2(e^{j\Omega_\mu}, k)$ that are input in a beamformer 112. The analysis filter banks 108 and 110 down-sample the microphone signals $x_1(n)$ and $x_2(n)$ by an appropriate down-sampling factor. The beamformer 112 may be a conventional fixed delay-and-sum beamformer with outputs of a beamformed sub-band signals $X_{BF}(e^{j\Omega_\mu}, k)$. Moreover, the beamformer 112 supplies the microphone sub-band signals or some modifications thereof to a feature extraction module 114 that is configured to extract a number of features from the signals. The features may be associated with the signal-to-noise ratio (SNR) obtained by normalized power densities of the microphone signals $x_1(n)$ and $x_2(n)$ and the noise contributions:

$$SNR(\Omega_\mu k)=\frac{\sigma_x^2(\Omega_\mu, k)}{\sigma_n^2(\Omega_\mu, k)}$$

with $$\sigma_x^2(\Omega_\mu, k)=\frac{1}{2}\left(|X_1(e^{j\Omega_\mu}, k)|^2+|X_2(e^{j\Omega_\mu}, k)|^2\right)$$

and $$\sigma_n^2(\Omega_\mu, k)=\frac{1}{2}\left(\hat{S}_{n1n1}(\Omega_\mu, k)+\hat{S}_{n2n2}(\Omega_\mu, k)\right)$$

with the noise power densities $\hat{S}_{n1n1}(\Omega_\mu, k)$ and $\hat{S}_{n2n2}(\Omega_\mu, k)$ estimated by approaches known in the art (see, e.g., R. Martin, "Noise power spectral density estimation based on optimal smoothing and minimum statistics", IEEE Trans. Speech Audio Processing, T-SA-9(5), pages 504-512, 2001).

Alternatively or additionally, the sum-to-difference ratio $$Q_{SD}(\Omega_\mu, k)=\frac{|X_1(e^{j\Omega_\mu}, k)+X_2(e^{j\Omega_\mu}, k)|^2}{|X_1(e^{j\Omega_\mu}, k)-X_2(e^{j\Omega_\mu}, k)|^2}$$

may be used as a feature. Furthermore, a feature may be represented by the output power density of the beamformer 112 normalized to the average power density of the microphone signals $x_1(n)$ 104 and $x_2(n)$ 106;

$$Q_{BF}(\Omega_\mu, k)=\frac{|X_{BF}(e^{j\Omega_\mu}, K)|^2}{\sigma_x^2(\Omega_\mu, K)}.$$

Also, alternatively or additionally, a feature may be represented (in each of the frequency sub-bands $\Omega_\mu$) by the mean squared coherence;

$$\Gamma(\Omega_\mu, k)=\frac{|\hat{S}_{x_1x_2}(\Omega_\mu, k)|^2}{\hat{S}_{x_1x_1}(\Omega_\mu, k)\hat{S}_{x_2x_2}(\Omega_\mu, k)}.$$

The features are input in a non-linear mapping module 116. The non-linear mapping module 116 maps the received features to previously learned filter weights. The mapping may be implemented as a neural network that receives the features as inputs and outputs the previously learned filter weights. Alternatively, the non-linear mapping module 116 may be implemented as a code book with a feature vector corresponding to an extracted feature stored in one code book that is mapped to an output vector comprising learned filter weights. The feature vector corresponding to the extracted feature or features may be found (e.g., by application of some distance measure). With a code book approach, the code book may be trained by sample speech signals prior to the actual use in the signal processor 102.

The filter weights obtained by the mapping performed by the non-linear mapping module 116 are employed to obtain filter weights for post-filtering the beamformed sub-band signals $X_{BF}(e^{j\Omega_\mu}, k)$. In some implementations, the learned filter weights may be directly used for the post-filtering of the beamformed sub-band signals via the post-filter 120. In other implementations, it might be desirable, however, to further process the learned filter weights in post-processing module 118 (e.g., by some smoothing) and to use the resulting filter weights in post-filter 120 to obtain enhanced beamformed sub-band signals $X_P(e^{j\Omega_\mu}, k)$. These enhanced beamformed sub-band signals $X_P(e^{j\Omega_\mu}, k)$ may then be synthesized by a synthesis filter bank 122 in order to obtain an enhanced processed speech signal $X_P(n)$ that are subsequently transmitted to a remote communication party or supplied to a speech recognition application or processor.

The sampling rate of the microphone signals $x_1(n)$ 108 and $x_2(n)$ 110 may be, for example, 11025 Hz, such that the analysis filter banks 108 and 110 may divide the $x_1(n)$ 108 and $x_2(n)$ 110 into 256 sub-bands. In order to reduce the complexity of the processing, sub-bands may be further subsumed in Mel bands, say 20 Mel bands. The 20 Mel bands may then be processed and features extracted with learned Mel band filter weights, $H_{NN}(\eta, k)$, being output by the non-linear module 116 (see FIG. 1) where η denotes the number of the Mel band. The learned Mel band filter weights $H_{NN}(\eta, k)$ may then be processed by the post-processing module 118 to obtain the sub-band filter weights $H_P(\Omega_\mu, k)$. The sub-band filter weights may then be employed as an input to the post-filter 120 to filter the beamformed sub-band signals $X_{BF}(e^{j\Omega_\mu}, k)$ in order to obtain enhanced beamformed sub-band signals $X_P(e^{j\Omega_\mu}, k)$. The post-processing may also include temporal smoothing of the learned Mel band filter weights $H_{NN}(\eta, k)$, e.g.;

$$\overline{H}_{NN}(\eta,k)=\alpha\overline{H}_{NN}(\eta,k-1)+(1-\alpha)H_{NN}(\eta,k)$$

with a real parameter α (e.g., α=0.5). The smoothed Mel band filter weights $\overline{H}_{NN}(\eta, k)$ may be transformed by the post-processing module 118 into the sub-band filter weights $H_P(\Omega_\mu, k)$.

Figure 2:
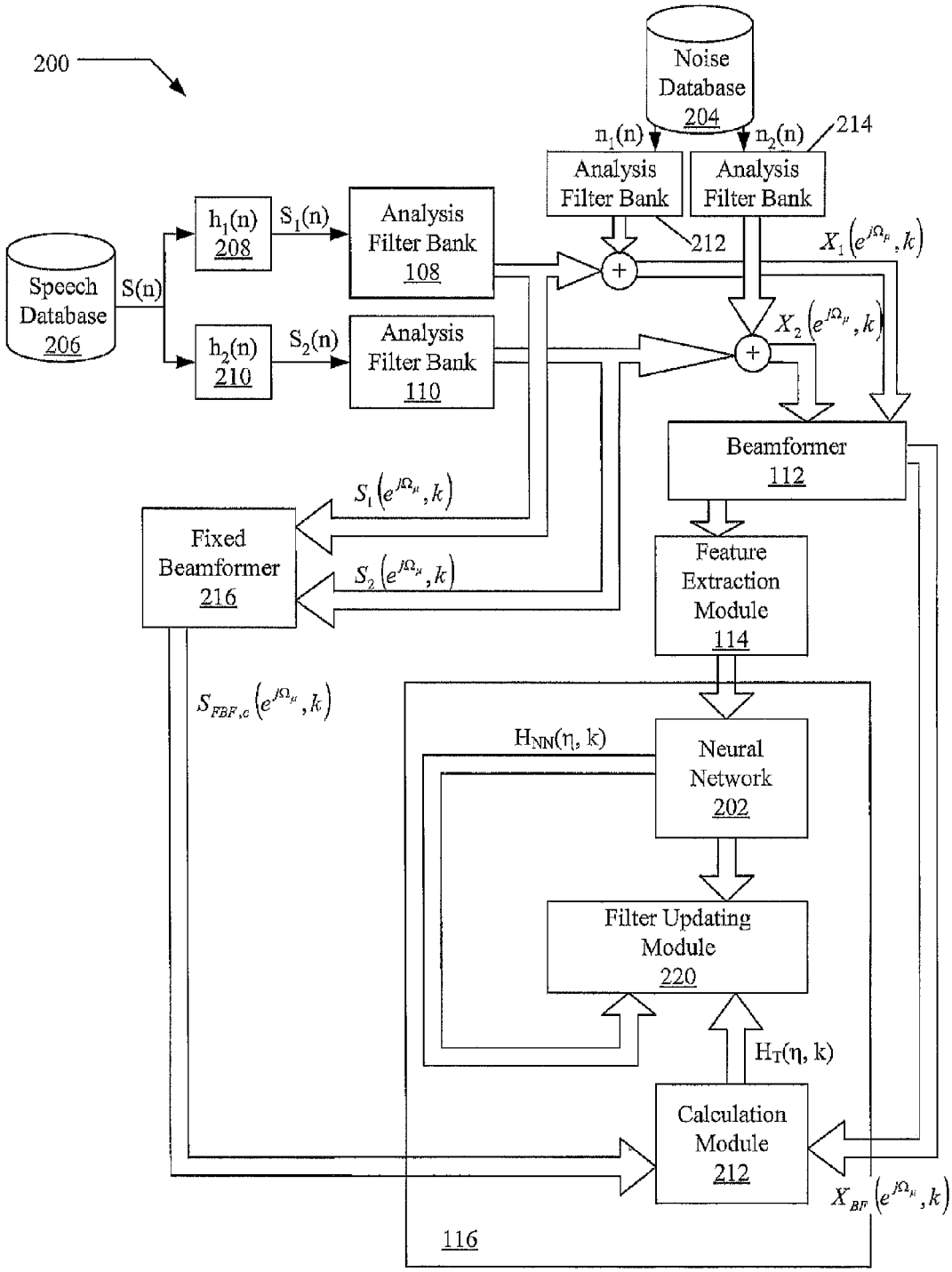
FIG. 2 is a block diagram of the signal processing of the beamformed signal along with training of the non-linear module of FIG. 1 that derives filter weights for the post-filter 120 according to an implementation of the invention.

In FIG. 2, a block diagram 200 of the signal processing of the beamformed signal along with training of the non-linear module 116 that derives filter weights for the post-filter 120 according to an implementation of the invention is shown. The previously learned filter weights are employed by the post-filter 120 when filtering the beamformed sub-band signals $X_{BF}(e^{j\Omega_\mu}, k)$. In the block diagram 200, a neural network 202 may be trained by sample signals $x_i(n)=s_i(n)+n_i(n)$, i=1, 2, where $s_i$ and $s_2$ are wanted signal contributions and $n_1$ and $n_2$ are noise contributions. For implementations comprising more than two microphones (i>2), i may be chosen according to the actual number of microphones. The noise contributions $n_1$ and $n_2$ are provided by a noise database 204 in which noise samples are stored. The wanted signal contributions may be derived from speech samples stored in a speech database 206 that are modified by a modeled impulse response ($h_1(n)$ 208 and $h_2(n)$) 210 of a particular acoustic room (e.g., a vehicular compartment) that the signal processor 102 of FIG. 1 shall be installed. In other implementations, the actual impulse response of an acoustic room in which the signal processor 102 shall be installed may be measured and employed rather than relying on a modeled impulse response.

Both the wanted signal contributions and the noise contributions may be divided into sub-band signals by analysis filter banks 108, 110, 212, and 214, respectively. Accordingly, sample sub-band signals $$X_i(e^{j\Omega_\mu},k)=S_i(e^{j\Omega_\mu},k)+N_i(e^{j\Omega_\mu},k)$$

are input to beamformer 112 that beamforms these signals to obtain beamformed sub-band signals $X_{BF}(e^{j\Omega_\mu}, k)$.

In addition, the wanted signal sub-band signals $S_1$ and $S_2$ are beamformed by a fixed beamformer 216 in order to obtain beamformed sub-band signals $S_{FBF,c}(e^{j\Omega_\mu}, k)$. The beamformer 112 provides a feature extraction module 114 with signals based on the microphone sub-band signals, (e.g., with these signals as input to the beamformer 112 or after some processing of these signals in order to enhance their quality). The feature extraction module 114 extracts features and may supply them to the neural network 202. The training consists of learning the appropriate filter weights $H_{P,opt}(\Omega_\mu, k)$ to be used by the post-filter 120 of FIG. 1 that correspond to the input weights such that ideally $$|X_{BF}(e^{j\Omega_\mu},k)\cdot H_{P,opt}(\Omega_\mu,k)|=|S_{FBF,c}(e^{j\Omega_\mu},k)|$$

holds true, (i.e., the beamformed wanted signal sub-band signals $S_{FBF,c}(e^{j\Omega_\mu}, k)$ are reconstructed from the beamformed sub-signals $X_{BF}(e^{j\Omega_\mu}, k)$ by means of a post-filter 120 comprising adapted filter weights $H_{P,opt}(\Omega_\mu, k)$). The ideal filter weights may also be called a teacher signal $H_T(\eta, k)$ where processing in η Mel bands is assumed. In the context of Mel band processing the teacher signal may be expressed by:

$$H_T(\eta,k)=\sqrt{\frac{\sum_{\mu=1}^{m}W_{mel,\eta}(\Omega_\mu)|S_{FBF,c}(e^{j\Omega_\mu},k)|^2}{\sum_{\mu=1}^{m}W_{mel,\eta}(\Omega_\mu)|X_{BF}(e^{j\Omega_\mu},k)|^2}}.$$

The weights may be chosen as a triangular form (see, e.g., L. Rabinder and B. H. Juang, "Fundamentals of Speech Recognition", Prentice-Hall, Upper Saddle River, N.J., USA, 1993).

A calculation module 218 receives the output $X_{BF}(e^{j\Omega_\mu}, k)$ of the fixed beamformer 216 and is employed to determine the teacher signal on the basis of that a filter updating module 220 teaches or configures the neural network 202 to adapt the Mel band filter weights $H_{NN}(\eta, k)$ accordingly. In detail, $H_{NN}(\eta, k)$ is compared to the teacher signal $H_T(\eta, k)$ and the parameters of the neural network may then be updated by the filter updating module 214 such that the cost function;

$$E(\eta)=\sum_{k=0}^{K-1}(H_T(\eta,k)-H_{NN}(\eta,k))^2$$

is minimized. In other implementations, a weighted cost function (error function) may be minimized for training the neural network 202, the weight cost function may be;

$$\tilde{E}(\eta)=\sum_{k=0}^{K-1}f(H_T(\eta,k))\cdot(H_T(\eta,k)-H_{NN}(\eta,k))^2,$$

where $f(H_T(\eta, k))$ denotes a weight function depending on the teacher signal, (e.g., $f(H_T(\eta, k))=0.1+0.9\,H_T(\eta, k)$). Training rules for updating the parameters of the neural network 202 may include a back propagation algorithm, a "Resilient Back Propagation algorithm," or a "Quick-Prop" algorithm to give but a few examples.

It should be noted that when a code book implementation is employed as the non-linear module rather than the neural network 202 of FIG. 2, a Linde-Buzo-Gray (LBG) algorithm or the k-means algorithm may be used for training, (i.e., the correct association of filter weights to input feature vectors). With this approach, the teacher function only has to be considered without taking into consideration outputs $H_{NN}(\eta, k)$ of the code book implementation during the learning process.

Figure 3:
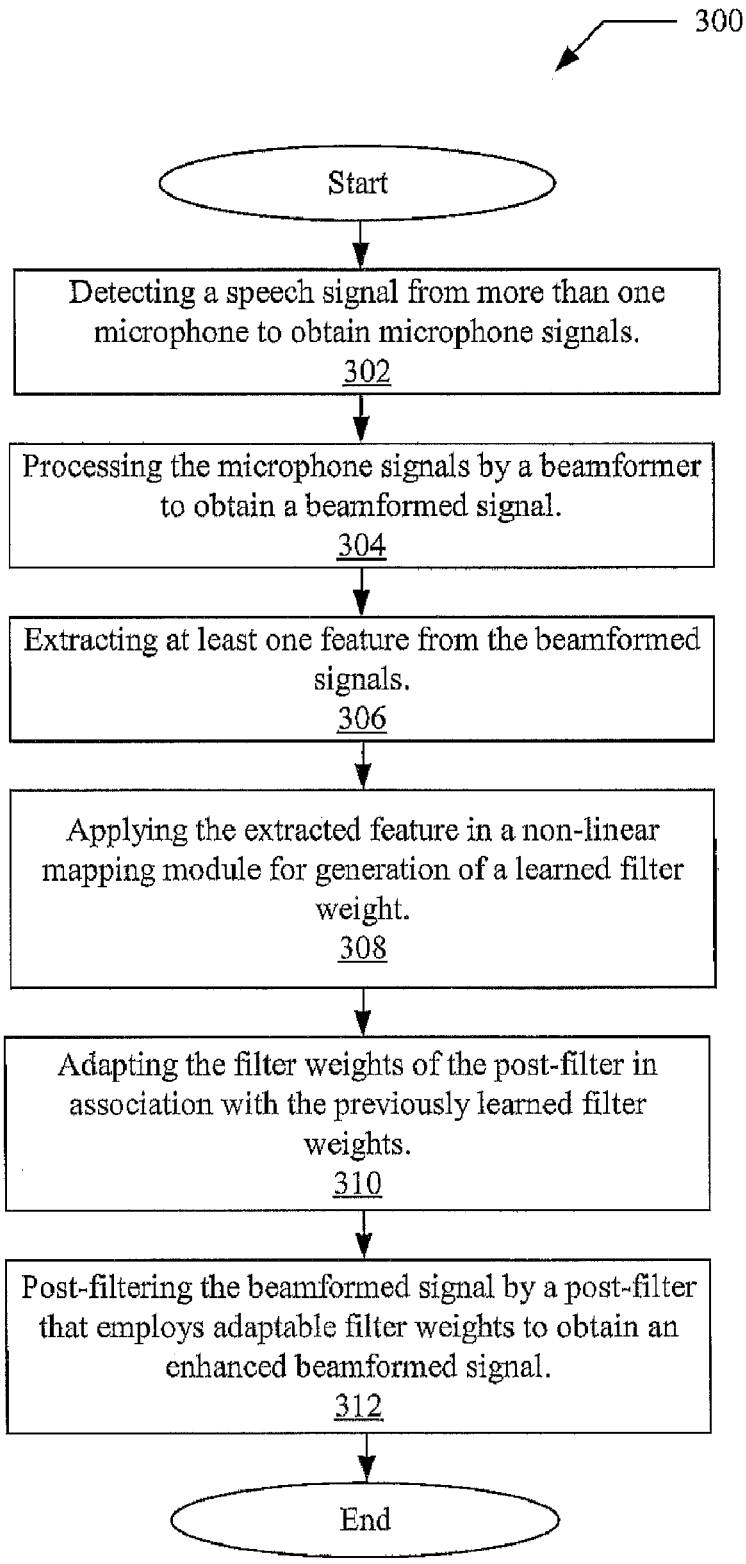
FIG. 3 is a flow diagram of the procedure of training the non-linear mapping module of FIG. 1 and FIG. 2 according to an implementation of the invention.

Turning to FIG. 3, a flow diagram 300 of the procedure of training the non-linear mapping module 116 of FIG. 1 and FIG. 2 according to an implementation of the invention is shown. The flow diagram 300 starts by detecting a speech signal from more than one microphone to obtain microphone signals 302 (such as microphone signals $X_1(n)$ 104 and $X_2(n)$ 108). The microphone signals may then be processed by a beamformer 112 to obtain a beamformed signal 304. A feature extractor module 114 may then extract at least one feature from the beamformed signal 306. A non-linear mapping module 116 may apply the at least one extracted feature and generating a learned filter weight 308. The learned filter weight may then be employed by a post-filter along with the previously learned filter weight or weights 310 for post-filtering the beamformed signals 312 to obtain an enhanced beamformed signal 312.

It will be understood, and is appreciated by persons skilled in the art, that one or more processes, sub-processes, or process steps described in connection with FIGS. 1, 2 and 3 may be performed by a combination of hardware and software. The software may reside in software memory internal or external to the signal processor 102 or other controller, in a suitable electronic processing component or system such as, one or more of the functional components or modules schematically depicted in FIGS. 1 and 2. The software in software memory may include an ordered listing of executable instructions for implementing logical functions (that is, "logic" that may be implemented either in digital form such as digital circuitry or source code or in analog form such as analog circuitry or an analog source such an analog electrical, sound or video signal), and may selectively be embodied in any tangible computer-readable medium for use by or in connection with an instruction execution system, apparatus, or device, such as a computer-based system, processor-containing system, or other system that may selectively fetch the instructions from the instruction execution system, apparatus, or device and execute the instructions. In the context of this disclosure, a "computer-readable medium" is any means that may contain, store, communicate, propagate, or transport the program for use by or in connection with the instruction execution system, apparatus, or device. The computer readable medium may selectively be, for example, but is not limited to, an electronic, magnetic, optical, electromagnetic, infrared, or semiconductor system, apparatus, device, or medium. More specific examples, but nonetheless a non-exhaustive list, of computer-readable media would include the following: a portable computer diskette (magnetic), a RAM (electronic), a read-only memory "ROM" (electronic), an erasable programmable read-only memory (EPROM or Flash memory) (electronic), and a portable compact disc read-only memory "CDROM" (optical) or similar discs (e.g. DVDs and Rewritable CDs). Note that the computer-readable medium may even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A method for speech signal processing, comprising:

detecting a speech signal by more than one microphone to obtain microphone signals;

processing the microphone signals with a beamformer to obtain a beamformed signal; and post-filtering the beamformed signal by a post-filter that employs adaptable filter weights to obtain an enhanced beamformed signal, where the post-filter adapts the filter weights with previously learned filter weights, where the learned filter weights are obtained by supervised learning, where the supervised learning comprises the steps of:

generating sample signals by superimposing a wanted signal contribution associated with the more than one microphone and a noise contribution for each of the sample signals;

inputting the sample signals, each comprising a wanted signal contribution and a noise contribution, into a beamforming means to obtain beamformed sample signals; and training filter weights for the post-filterer such that beamformed sample signals filtered by a filter updating module use the trained filter weights to approximate the wanted signal contributions of the sample signals.

2. The method of claim 1, further including:

extracting at least one feature from the microphone signals;

inputting the at least one extracted feature into a non-linear mapping module;

outputting the previously learned filter weights by the non-linear mapping module in response to the extracted at least one feature; and adapting the filter weights of the post-filtering module in response to the learned filter weights output by the non-linear mapping module.

3. The method of claim 2, where the non-linear mapping is performed by a trained neural network.

4. The method of claim 3, further including:

dividing the microphone signals into microphone sub-band signals;

Mel band filtering the sub-band signals;

extracting at least one feature from the Mel band filtered sub-band signals;

outputting the learned filter weights by the non-linear mapping module as Mel band filter weights; and processing the Mel band filter weights output by the non-linear mapping module to obtain filter weights in a frequency domain to adapt the filter weights of the post-filter.

5. The method of claim 4, where the Mel band filter weights output by the non-linear mapping module further include temporal smoothing of the Mel band filter weights.

6. The method of claim 4, where the at least one feature is the signal power densities of the microphone signals.

7. The method of claim 4, where the at least one feature is a ratio of the squared magnitude of the sum of two microphone sub-band signals and the squared magnitude of the difference of two microphone sub-band signals.

8. The method of claim 4, where the at least one feature is an output power density of the normalized average power density of the microphone signals.

9. The method of claim 4, where the at least one feature is a mean squared coherence of two microphone signals.

10. The method of claim 1, where the enhanced beamformed signal, $X_p$, is obtained by the post-filter is according to $X_p = H X_{BF}$, where H denotes the adapted filter weights of the post-filter and $X_{BF}$ denotes the beamformed signal.

11. The method of claim 1, further includes:

beamforming the wanted signal contributions of the sample signals by a fixed beamformer to obtain beamformed wanted signal contributions of the sample signals; and training filter weights for the post-filtering module such that beamformed sample signals filtered by a filtering updating module where the trained filter weights approximate the beamformed wanted signal contributions of the sample signals.

12. A computer program product for performing speech signal processing to reduce background noise, the computer program product comprising a nontransitory computer readable medium encoded with computer readable program code, the computer readable code including:

program code for detecting a speech signal by more than one microphone to obtain microphone signals;

program code for processing the microphone signals with a beamformer to obtain a beamformed signal; and program code for post-filtering the beamformed signal by a post-filter that employs adaptable filter weights to obtain an enhanced beamformed signal, where the post-filter adapts the filter weights with previously learned filter weights, where the learned filter weights are obtained by supervised learning, where the supervised learning comprises:

generating sample signals by superimposing a wanted signal contribution associated with the more than one microphone and a noise contribution for each of the sample signals;

inputting the sample signals, each comprising a wanted signal contribution and a noise contribution, into a beamforming means to obtain beamformed sample signals; and training filter weights for the post-filterer such that beamformed sample signals filtered by a filter updating module use the trained filter weights to approximate the wanted signal contributions of the sample signals.

13. The computer program product according to claim 12, further including:

program code for extracting at least one feature from the microphone signals;

program code for inputting the at least one extracted feature into a non-linear mapping module;

program code for outputting the previously learned filter weights by the non-linear mapping module in response to the extracted at least one feature; and program code for adapting the filter weights of the post-filtering module in response to the learned filter weights output by the non-linear mapping module.

14. The computer program product according to claim 13, where the non-linear mapping is performed by a trained neural network.

15. The computer program product according to claim 14, further including:

program code for dividing the microphone signals into microphone sub-band signals;

program code for Mel band filtering the sub-band signals;

program code for extracting the at least one feature from the Mel band filtered sub-band signals;

program code for outputting the learned filter weights by the non-linear mapping module as Mel band filter weights; and program code for processing the Mel band filter weights output by the non-linear mapping module to obtain filter weights in a frequency domain to adapt the filter weights of the post-filter.

16. The computer program product according to claim 15, where the Mel band filter weights output by the non-linear mapping module further include temporal smoothing of the Mel band filter weights.

17. The computer program product according to claim 15, where the at least one feature is the signal power densities of the microphone signals.

18. The computer program product according to claim 15, where the at least one feature is a ratio of the squared magnitude of the sum of two microphone sub-band signals and the squared magnitude of the difference of two microphone sub-band signals.

19. The computer program product according to claim 15, where the at least one feature is an output power density of the normalized average power density of the microphone signals.

20. The computer program product according to claim 15, where the at least one feature is a mean squared coherence of two microphone signals.

21. The computer program product according to claim 12, where the enhanced beamformed signal, $X_P$, is obtained by the post-filter according to $X_P = H\,X_{BF}$, where H denotes the adapted filter weights of the post-filter and $X_{BF}$ denotes the beamformed signal.

* * * * *